US006045679A

United States Patent [19]

Slot et al.

[11] Patent Number: 6,045,679

[45] Date of Patent: Apr. 4, 2000

[54] METHOD FOR MANUFACTURING AN IMAGE-FORMING ELEMENT

[75] Inventors: Marcel Slot; Norbertus G. C. M. Van Reuth, both of Venlo, Netherlands

[73] Assignee: Oce-Technologies B.V., Ma Venlo, Netherlands

[21] Appl. No.: 08/840,716

[22] Filed: Apr. 25, 1997

[30] Foreign Application Priority Data

Apr. 25, 1996 [EP] European Pat. Off. ..... 96201108

[51] Int. Cl.[7] ..... B41C 3/08

[52] U.S. Cl. ..... 205/127; 205/323; 205/921

[58] Field of Search ..... 205/323, 328, 205/127, 918, 921, 173, 150, 75

[56] References Cited

U.S. PATENT DOCUMENTS 5,483,269 1/1996 Van Stiphout et al. ..... 347/55

FOREIGN PATENT DOCUMENTS

247699A1 5/1987 European Pat. Off. .
0 247 669 A1 12/1987 European Pat. Off. .
595388A1 10/1993 European Pat. Off. .
635768A1 6/1994 European Pat. Off. .

*Primary Examiner*—Kathryn Gorgos
*Assistant Examiner*—Erica Smith-Hicks
*Attorney, Agent, or Firm*—Birch, Stewart, Kolasch & Birch, LLP

[57] ABSTRACT

Method for manufacturing an image-forming element having a hollow cylindrical drum body with a metallic outer layer and provided on its outer circumferential surface with a plurality of circumferentially extending electrodes which are electrically insulated from one another and from the drum body. The steps include cutting grooves into the metallic outer layer of the drum body, forming an insulating surface layer at least on the internal walls of the grooves by converting the surface of the metallic outer layer into an insulating substance, and filling the grooves with electrically conductive material.

22 Claims, 4 Drawing Sheets

METHOD FOR MANUFACTURING AN IMAGE-FORMING ELEMENT

BACKGROUND OF THE INVENTION

1. Field of the Invention

The invention relates to a method for manufacturing an image-forming element having a hollow cylindrical drum body with a metallic outer layer and provided on its outer circumferential surface with a plurality of circumferentially extending electrodes which are electrically insulated from one another and from the drum body.

2. Description of Background Art

An image-forming element of this type is usable in a so-called direct induction printer the functional principle of which is described for example in EP-A1-0 247 699. In such a printer, the electrodes on the surface of the drum body are covered by a dielectric layer, and a rotatable sleeve is disposed along the drum body so that the surfaces of the drum body and the sleeve form a gap which extends at right angles to the electrodes of the drum. A stationary magnetic knife is disposed inside of the sleeve for generating a magnetic field in the gap. A uniform layer of electrically conductive and magnetically attractable toner powder is applied to the surface of the sleeve.

In an image-forming zone defined by the magnetic field in the gap, the toner powder is transferred onto the surface of the drum, depending on the voltage applied to the electrodes thereof. Thus, by rotating the drum body and energizing the electrodes in accordance with image information supplied to the control unit, a toner image is formed on the surface of the drum. Alternatively, a uniform layer of toner powder may be applied to the surface of the drum, and the toner powder may be selectively removed from the drum in accordance with the energizing pattern of the electrodes.

A conventional image-forming element and a method of manufacturing the same are disclosed in EP-A1-0 595 388. The electronic components of the control unit and a pattern of electric conductors are provided on a plate-like substrate. The conductors to be connected to the electrodes of the drum terminate at a rectilinear edge of the substrate, so that a terminal array is formed. The substrate carrying the conductor pattern and the electronic components is mounted inside of an aluminum cylinder forming the drum body such that the terminal array is inserted through a longitudinal slot of the drum body. The remaining free spaces in the slot are filled with epoxy resin so that the terminals are insulated from the drum body. The edge portion of the substrate projecting out of the slot is etched away so that only the ends of conductors are left, which will then slightly project beyond the surface of the cylindrical drum. The surface of the cylinder is then covered with an insulating layer (epoxy) having a thickness equal to the length of the projecting ends of the conductors. Then, the electrodes are formed by cutting grooves into the insulating layer and filling them with conductive material. Thus, each electrode will be in contact with the end of one of the conductors of the control unit. Finally, the electrodes are covered with a layer of dielectric material.

It will be understood that the pitch of the electrodes determines the resolution of the printer. For example, in the case of a printer with a resolution of 23.6 pixel per mm (600 dpi), the pitch of the electrodes will be no larger than approximately 40 $\mu$m. Since a sufficient insulating gap must be provided between adjacent electrodes, the width of each individual electrode will be as small as approximately 20 $\mu$m.

With the conventional manufacturing method, it is difficult and cumbersome to reliably and reproducibly form the electrodes, which may be several thousands in number, at the correct positions and with sufficient electrical insulation therebetween. EP-A1-0 595 388, cited above, mentions the possibility of replacing the insulating epoxy layer, into which the grooves are cut, with an oxide layer formed by anodizing the aluminum cylinder. Then, however, it would be even more difficult to cut the grooves into the comparatively hard metal oxide layer.

SUMMARY AND OBJECTS OF THE INVENTION

It is an object of the invention to provide a more reliable, efficient and less costly method for manufacturing an image-forming element of the type indicated in the prior art.

This object is achieved according to the invention, by providing the grooves that are cut into the metallic (e.g. aluminum) outer layer of the drum body before the same is surface treated (e.g. oxidized or anodized) to make it electrically insulating. The drum body is made of a suitable metallic material that exhibits comparatively high ductility and the good electrical and heat conductivity, such as aluminum. The mechanical cutting methods or properties of aluminum allow for high, speed machining of the grooves in the drum body, whether machining by mechanical and electron beam method. The shape and the positions of the grooves can be controlled with high accuracy. Thus, it is assured that the individual grooves are separated by ridges with a predetermined width, and the quality of the manufacturing process is greatly improved, i.e. the process is simplified when compared with the previously mentioned prior art process and consequently the manufacturing costs are reduced, because metal such as aluminum can be easily processed.

In the subsequent surface treatment step (e.g. anodizing step), the surface layer of the drum body having the pattern of grooves cut therein is made electrically insulating. The thickness of the insulating (metal oxide) layer can be easily adjusted by appropriately controlling the parameters of the treatment (oxidizing or anodizing) process. The geometry of the grooves and the intervening ridges is not substantially changed in the treatment (oxidizing or anodizing) process, since only the chemical composition of the surface layer is changed, without any material being removed from or deposited on the drum surface. Thus, not only the width of each electrode track but also the diameter of the electrode layer of the drum body can be reproduced with high accuracy, which results in an improved image quality. In addition, the anodizing process, which is preferably used for converting the metallic outer layer into an insulating substance, provides an improved hardness of the internal walls of the grooves and of the ridges therebetween, so that the mechanical strength is improved. Thus, the groove pattern will reliably retain its integrity when the grooves are filled with conductive material and the surfaces are then covered with a dielectric layer.

The manufacturing process according to the invention is particularly useful if the electrical connections between the electrodes and a control unit disposed inside of the drum body are formed by through-holes passing through the wall of the drum body and filled with conductive material. In this case, the internal walls of the through-holes in the drum body and the walls of the grooves forming the electrodes can be made electrically insulating in one and the same anodizing step.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
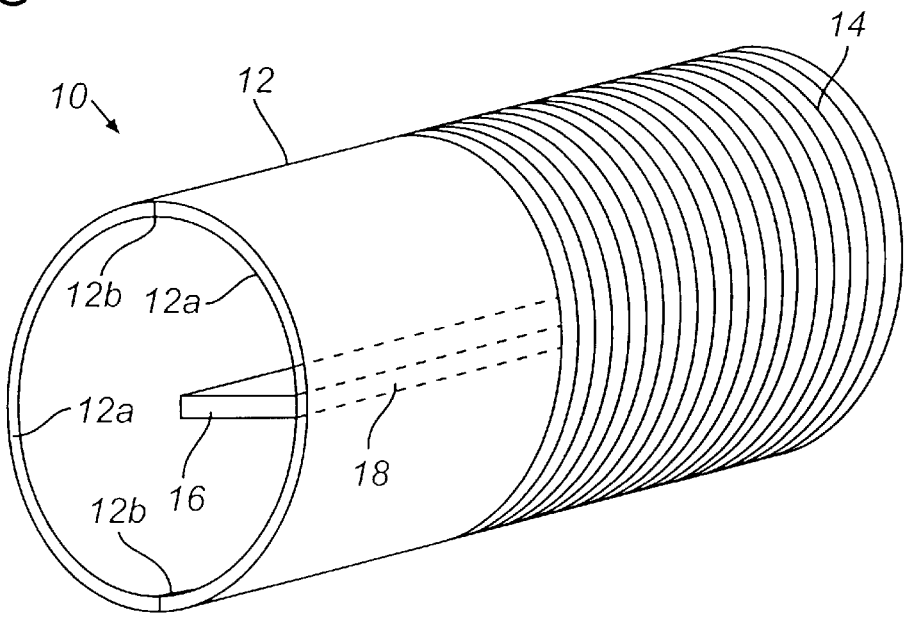
FIG. 1 is a schematic perspective view of an image-forming element.

The image-forming element 10 shown in FIG. 1 comprises a hollow cylindrical drum body 12 made of metal, preferably aluminum or an aluminum alloy. A plurality of circumferentially extending electrodes 14 are formed on the outer surface of the drum body 12. These electrodes 14 are electrically insulated from one another and from the drum body 12 and are covered by a thin layer of dielectric material (not shown in FIG. 1). While only a few electrodes 14 have been shown in FIG. 1 for reasons of clarity, the electrodes 14 are in practice provided substantially over the whole length of the drum body 12 and are arranged with a pitch of about 40 $\mu$m for example, corresponding to the desired resolution of the images to be formed.

A control unit 16 is shaped as an elongated body and is mounted inside of the hollow drum body 12 such that a terminal array 18 formed at a longitudinal edge of the elongated body adjoins the internal wall surface of the drum body. As is generally known in the art, the control unit 16 is arranged for individually applying a suitable high voltage to each of the electrodes 14 in accordance with the image information. For example, the control unit 16 may comprise a printed circuit board on which the electronic components are mounted and which carries a pattern of electrical conductors (not shown) which lead to the terminal array 18. Each of the conductors is electrically connected to a corresponding one of the electrodes 14 by contact means which will be described hereinafter.

Figure 2:
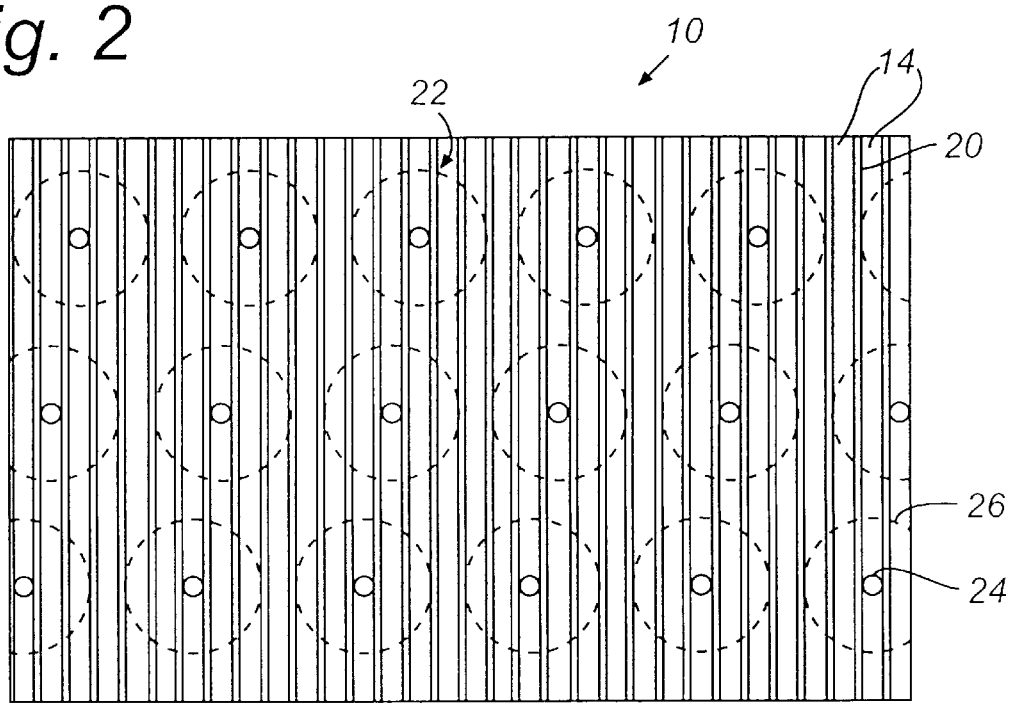
FIG. 2 is an enlarged view of a portion of the outer circumferential surface of the image-forming element.

As is shown in FIG. 2, the individual electrodes 14 are separated by insulating ridges 20 which, in the present example, have a width of slightly less than 20 $\mu$m, so that there remains a width of a bit more than 20 $\mu$m for each electrode 14. Each electrode is electrically connected to the associated conductor of the control unit 16 via a through-hole 22 which penetrates the wall of the drum body 12 and is filled with an electrically conductive material such as electrically conductive epoxy resin, solder paste, electrically conductive polymers or the like. Each through-hole 22 is composed of a small diameter portion or hole 24 and a large diameter portion or hole 26. The small diameter hole 24 is open to the outer circumferential surface of the drum body, has a diameter of approximately 20 $\mu$m and is so arranged that it makes contact with only one of the electrodes. The inner end of the small diameter hole 24 is open to the large diameter hole 26 which itself is open to the internal surface of the wall of the drum body 12 and has a diameter which is substantially larger than the pitch of the electrodes 14. In order to provide a sufficient clearance between the several large diameter holes 26, the through-holes 22 are staggered in the circumferential direction of the drum in six rows of which only three have been shown in FIG. 2.

When the control unit 16 is mounted inside the drum body 12, it has to be so adjusted that each of its conductors or terminals makes contact with the conductive material in only one of the large diameter holes 26. Because of the comparatively large diameter of these holes, the positional tolerance for the control unit is significantly larger than the pitch of the electrodes 14.

Figure 3:
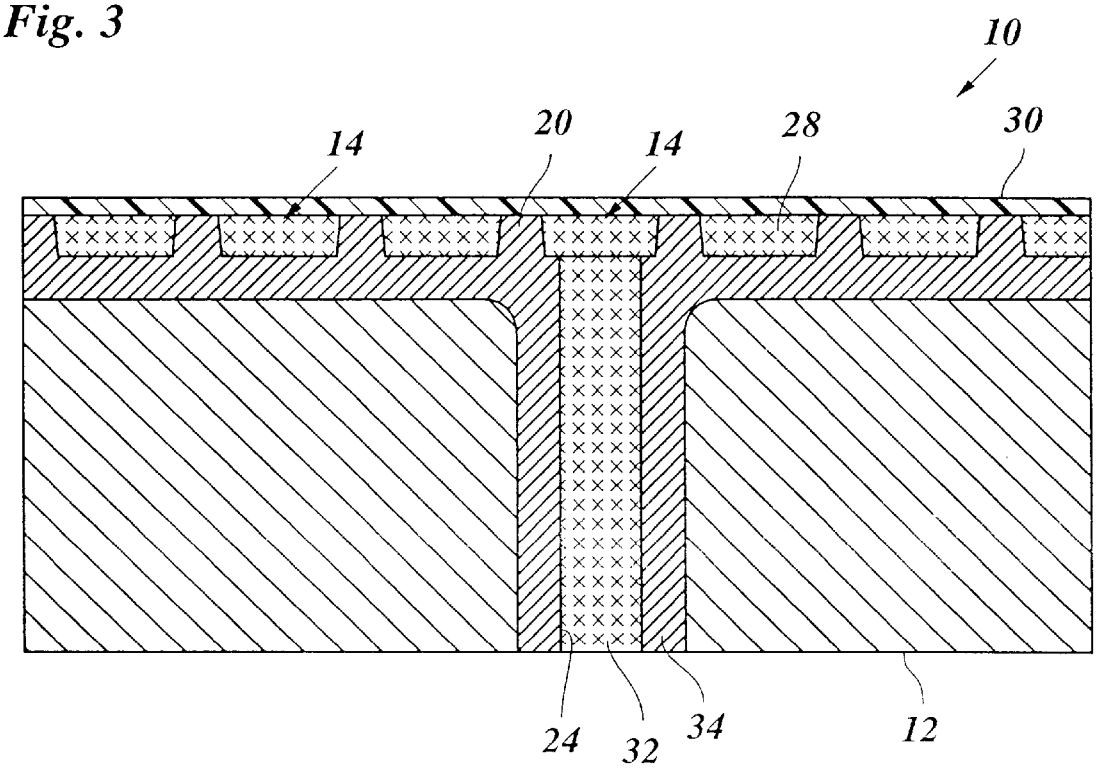
FIG. 3 is a cross-sectional view of a surface portion of the image-forming element.
Figure 4:
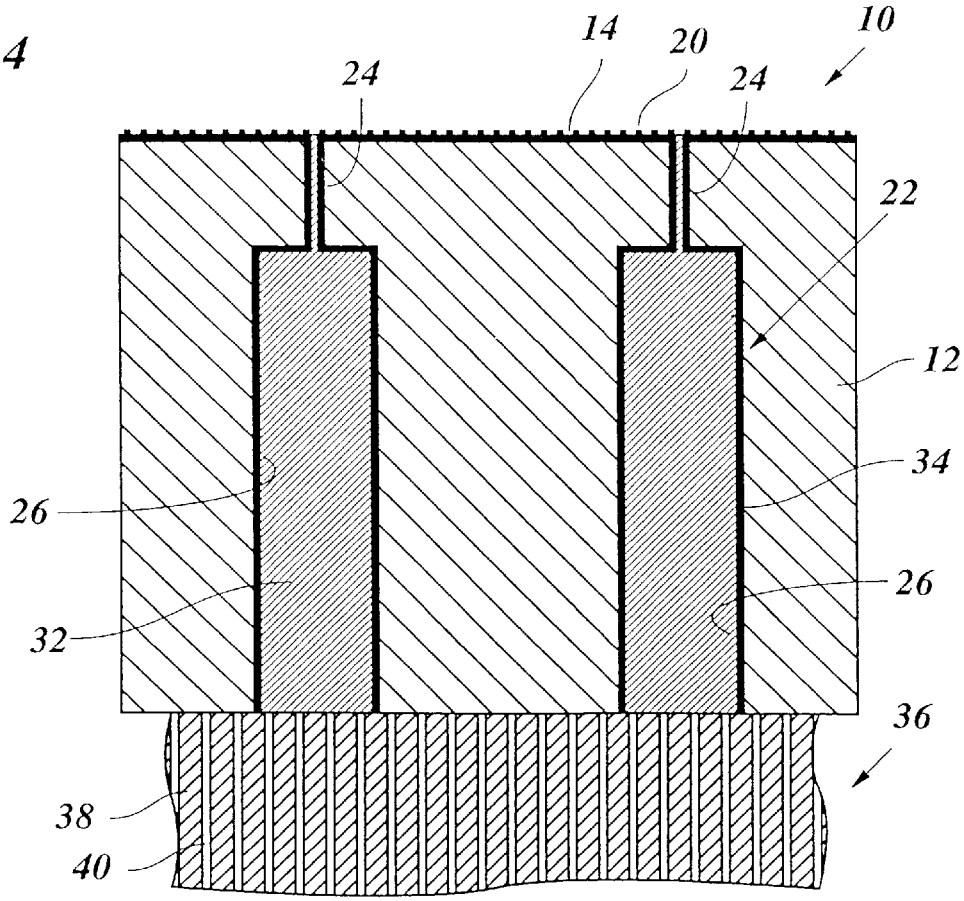
FIG. 4 is a cross-sectional view of a portion of the circumferential wall of the image-forming element at a smaller scale than in FIG. 3.

As is shown in FIGS. 3 and 4, the electrodes 14 are formed as grooves separated by the ridges 20 and filled with electrically conductive material 28. FIGS. 3 and 4 also show the dielectric layer 30 covering the electrodes 14 filled with the conductive material 28 and the ridges 20 as well as the electrically conductive material 32 with which the small diameter portions 24 and the large diameter portions 26 of the through-holes 22 are filled. The conductive material 28 forming the electrodes 14 is electrically insulated from the aluminum drum body 12 by an anodized surface layer 34 ($Al_2O_3$) which is present at the outer circumferential surface of the drum body and at the internal walls of the through-holes.

As is shown in FIG. 4, a so-called zebra-strip 36 is disposed at the inner wall surface of the drum body 12 in order to provide an electrical connection between the conductive material 32 filled in the large diameter holes 26 and the conductors of the control unit 16 which is illustrated in FIG. 1. This zebra-strip 36 is made of a resilient material which is elastically pressed between the internal wall of the drum body 12 and the terminal array 18 of the control unit 16, as illustrated in FIG. 1, and is composed of alternating layers 38 which are made electrically conductive and insulating layers 40. Thus, if the terminals of the control unit are arranged to overlap with the holes 26, each conductor is safely connected with the corresponding one of the holes 26 and accordingly with the electrode 14 associated therewith. In the shown embodiment, each hole 26 overlaps with three conductive layers 38 of the zebra-strip, so that an electrical connection is assured via three parallel electrical paths. In order to keep the adjacent electrodes 14 electrically separated from each other, it is of course necessary to provide separate zebra-strips 36 for each of the rows of through-holes 22 shown in FIG. 2.

The zebra-strips 36 may be replaced by a material which has anisotropic electric conductivity such as an electrically anisotropic lacquer.

A reliable and efficient method for manufacturing an image-forming element as described above will now be explained in conjunction with FIG. 3 and 4.

At first, the hollow cylindrical drum body 12 is formed as a one-piece member. The grooves 14 which are to form the electrodes are then cut into the circumferential surface of the drum body 12 for example by means of a diamond chisel. Alternatively, these grooves may be formed by means of a laser beam or an electron beam. It should be noted, that, at this stage, the drum body 12 has not yet been anodized so that the grooves 14 are formed in a metal surface which can be machined more easily and more precisely than a metal oxide layer.

In the next step, the large diameter holes 26 are cut into the wall of the drum body 12 from inside, for example by means of a laser beam. The holes 26 are at first formed as blind bores, and the smaller emitter holes 24 are then formed in a second step. The small diameter holes 24 may also be formed with a laser beam, either from the inside or outside of the drum. If they are cut from outside of the drum, the positional relationship between the small diameter holes 24 and the grooves 14 can readily be confirmed. In this case, it will also be possible to form the small diameter holes 24 by punching or cutting with a diamond chisel or the like, instead of using a laser beam or an electron beam.

On the other hand, if the small diameter holes 24 are formed from inside of the drum, it is possible to form the large diameter holes 26 and the small diameter holes 24 in a single step, e.g. by means of a convergent laser beam, or two beams from different laser types aligned along the same optical axis.

After the through-holes 22 including the small diameter portions 24 and the large diameter portions 26 have been formed, the whole drum body 12 is anodized according to known anodizing techniques, so as to form the insulating metal oxide layer 34 on the whole surface of the drum body, especially on the outer circumferential surface forming the grooves 14 and the ridges 20 and on the internal walls of the through-holes 22.

In the next step, the electrically conductive material 28,is filled into the grooves 14 and the electrically conductive material 32 is filled into the through-holes 22 so as to complete the electrodes and the electrical through-contacts.

Finally, the insulating dielectric layer 30, which for example may be formed of AIN, $Al_2O_3$ or of SiOx as described in EP-A-0635768 is formed over the electrodes 14 and the ridges 20, and the control unit 16 is mounted inside of the drum body to be connected to the through-contacts via the zebra-strips 36.

Depending on the diameter of the drum body 12 and the dimensions of the tools used for forming the large diameter holes 26, it may be necessary that the drum body 12 is composed of two or more segments in order to provide free access to the internal surface. In this case, the large diameter holes 26 are formed by means of a laser beam or electron beam in the individual segments, and then the segments are joined and welded together, preferably by electron beam welding, in order to form the hollow cylindrical drum body 12. In the example shown in FIG. 1, the drum body is composed of two segments 12*a* joined together along weld seams 12*b*.

The outer surface of the drum body 12 is ground and finished in order to obtain an exact cylindrical shape, and then the grooves 14 are cut. These steps are preferably performed on a lathe.

The subsequent steps of the manufacturing process may be the same as have been described above.

Alternatively, the drum body may be anodized immediately after the grooves 14 have been cut, i.e. before the small diameter holes 24 have been formed. In this case, the anodizing process must be controlled so that the insulating oxide layer penetrates into the metal or aluminum body at least to the level of the outer ends of the large diameter holes 26. The small diameter holes 24 are then formed in the oxide layer by laser cutting, punching or the like. Thus, when the conductive material 32 is filled in, it is assured that this material is perfectly insulated from the aluminum body 12.

Figure 6:
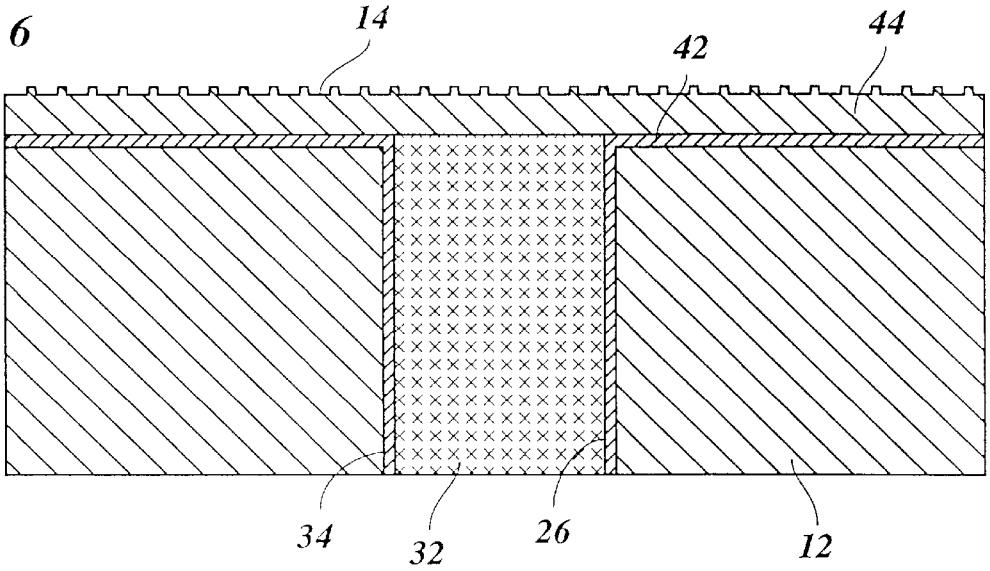
Figure 7:
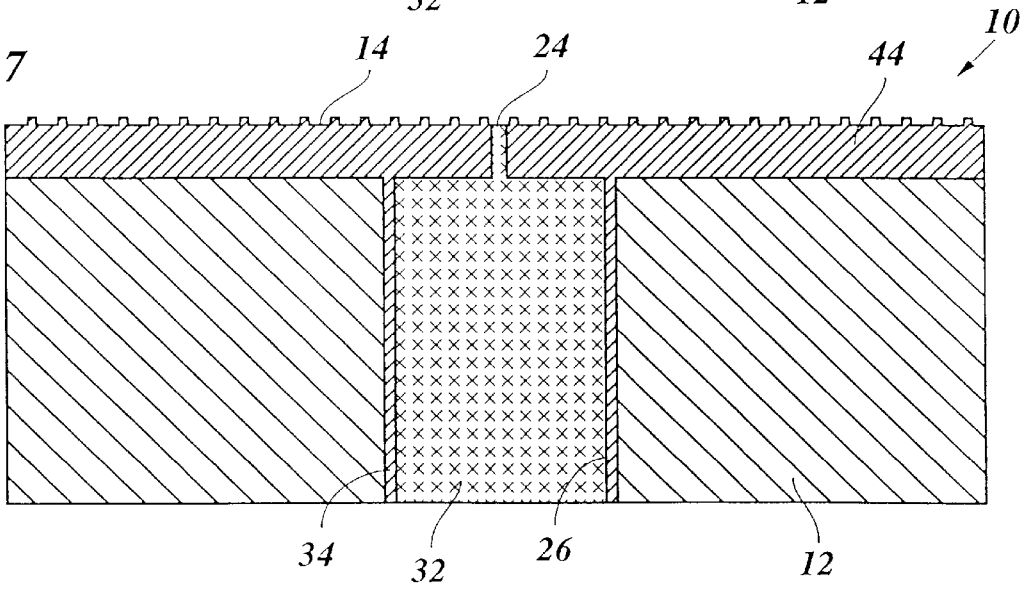

A modified embodiment of an image-forming element and a process for manufacturing the same will now be described in conjunction with FIGS. 5 to 7.

Figure 5:
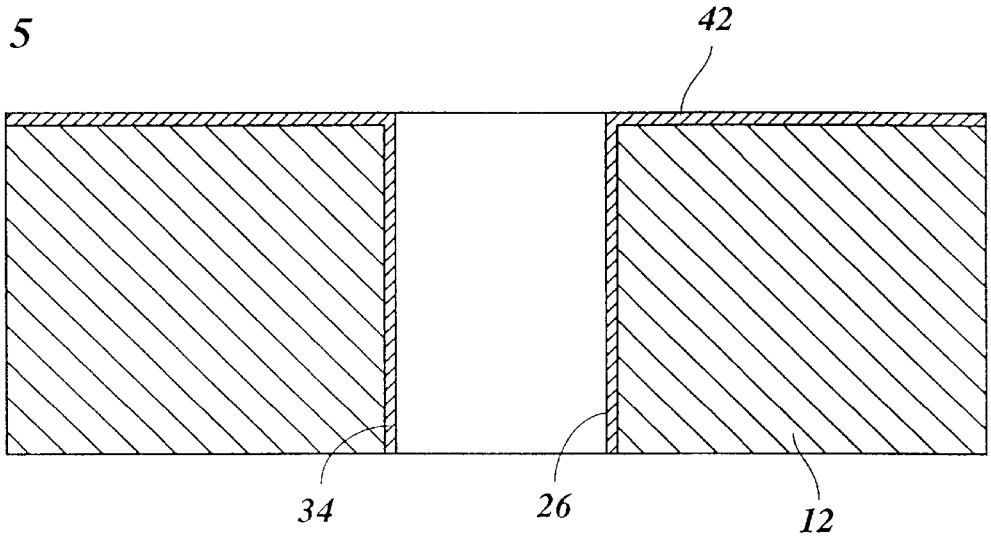
FIGS. 5 to 7 are cross-sectional views similar to FIG. 4 and illustrate three steps of a manufacturing process for an image-forming element according to a modified embodiment.

The main difference in the manufacturing processes described above is that the large diameter hole 26 is at first formed through the entire wall thickness of the drum body 12, as is shown in FIG. 5. The drum body 12 is then anodized to form an insulating layer 42 on the outer circumferential surface of the drum body as well as the insulating surface layer 34 on the internal walls of the holes 26. The holes 26 are filled with the electrically conductive material 32, as is shown in FIG. 6. Then, a layer 44 of metallic aluminum is disposed on the layer 42 on the outer surface of the drum body, for example by physical vapor deposition. Thereafter, the grooves 14 are cut into the layer 44, as is also shown in FIG. 6.

The drum body 12 is then subjected to a second anodizing step in which the whole thickness of the layer 44 is transformed into an electrically insulating metal oxide. Finally, the small diameter holes 24 are formed through the insulating layer 44 and are filled with electrically conductive material to achieve the configuration shown in FIG. 7.

In this embodiment, the same techniques as in the previous embodiment may be used for forming the large diameter holes 26 and the small diameter holes 24. Thus, the drum body 12 may either be an integral hollow cylindrical body from the outset or may be composed of several segments welded together after the holes 26 have been formed.

Figure 8:
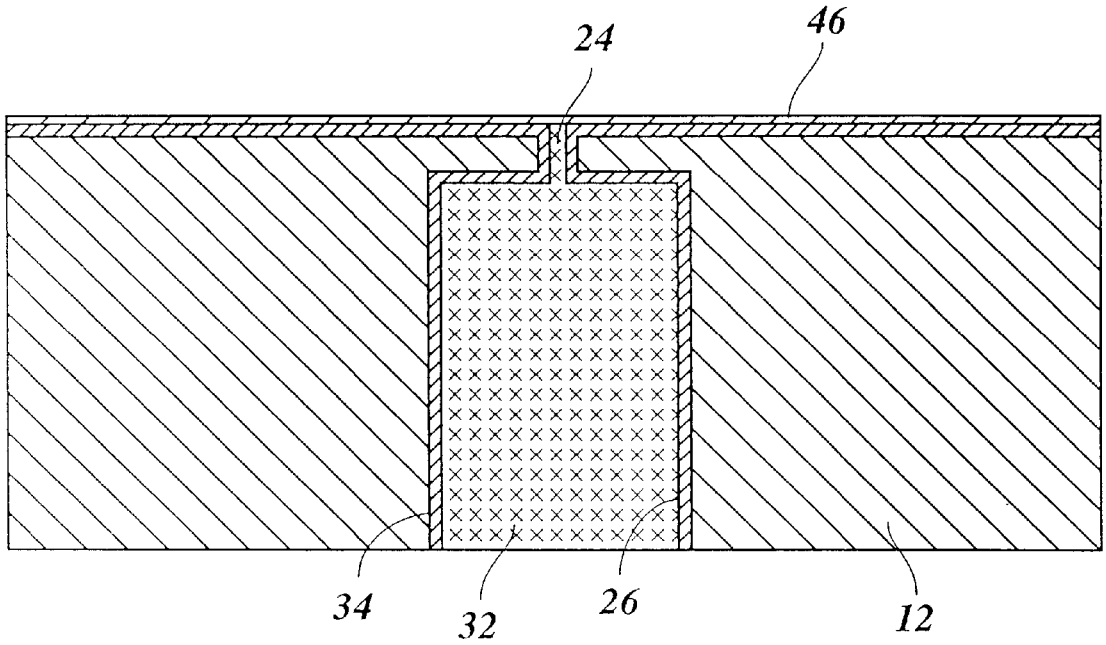
FIG. 8 is a cross-sectional view illustrating another manufacturing process.

According to a modification of the manufacturing process, the large diameter holes 26 and the small diameter holes 24 may be formed in the same way as has been described in conjunction with FIGS. 3 and 4, but without forming the grooves 14 in the outer surface of the drum body. If the drum body is composed of several segments, these segments may be welded together either before or after the small diameter holes 24 have been formed. The drum body is then subjected to a first anodizing step, and the large diameter holes 26 and the small diameter holes 24 are filled with conductive material 32. Then, as is shown in FIG. 8, a continuous layer 46 of metal or metallic aluminum is applied on the outer surface of the drum body 12, thus covering the open ends of the small diameter holes 24.

Subsequently, the grooves are cut into the layer 46, so that the outward ends of the small diameter holes 24 are again exposed at the bottoms of the grooves. The remaining parts of the layer 46 (i.e. the ridges) are then made electrically insulating in a second surface treatment step (e.g. an oxidizing or anodizing step), so that a configuration similar to that of FIG. 7 is achieved.

Finally, the grooves are filled with conductive material, and the dielectric layer is applied as has been described in conjunction with FIG. 3. In a particular embodiment the grooves, e.g. by physical vapor deposition, are filled with metal or aluminum and the deposition of metal or aluminum is continued until a thin layer (of about 0.8 to 3 $\mu$m thickness) is formed over the ridges. A dielectric layer is now formed by anodizing the thus deposited metal or aluminum to such a depth that the layer thickness covering the ridges is fully anodized.

While only specific embodiments of the invention have been described above, it will occur to a person skilled in the art that the described examples may be modified in various ways without departing from the scope of the invention as defined in the appended claims. For example, the control unit 16 may be divided into several blocks angularly offset from one another and extending each over a different part of the length of the drum body. The through-holes 22 will then be arranged in accordance with this pattern.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A method for manufacturing an image-forming element having a hollow cylindrical drum body with a metallic outer layer and provided on its outer circumferential surface with a plurality of circumferentially extending electrodes which are electrically insulated from one another and from the drum body, comprising the steps of:

first, cutting grooves with internal walls directly into said metallic outer layer of the drum body;

second, forming an insulating surface layer at least on the internal walls of said grooves by converting the surface of said metallic outer layer into an insulating substance, said insulating surface layer being formed after the grooves are cut on at least the internal walls of said grooves by anodizing said metallic outer layer; and third, filling said grooves with electrically conductive material after said insulating surface layer is formed for forming said image-forming element on the drum body.

2. The method according to claim 1, wherein through-holes are formed in the wall of the drum body, the internal walls of the through-holes are anodized concurrently with the internal walls of the grooves, and the through-holes are filled with electrically conductive material for connecting each electrode to a control unit disposed inside of the drum body.

3. The method according to claim 1, wherein a metal layer is deposited on the outer surface of the drum body, and the grooves are cut into the deposited layer.

4. The method according to claim 1, wherein a metal layer is deposited on the outer surface of the drum body, and the grooves are cut into the deposited layer.

5. The method according to claim 1, wherein the grooves are formed by laser beam cutting.

6. The method according to claim 2, wherein the grooves are formed by laser beam cutting.

7. The method according to claim 1, wherein the grooves are formed by electron beam cutting.

8. The method according to claim 2, wherein the grooves are formed by electron beam cutting.

9. The method according to claim 1, wherein the grooves are formed by mechanical cutting.

10. The method according to claim 2, wherein the grooves are formed by mechanical cutting.

11. The method according to claim 1, wherein the grooves are formed by a diamond chisel.

12. The method according to claim 2, wherein the grooves are formed by a diamond chisel.

13. The method according to claim 1, and further including the step of forming ridges between the grooves, said ridges are constructed of metal and a dielectric surface layer is formed by anodizing the metal to a depth equal to the layer thickness covering the ridges.

14. The method according to claim 2, and further including the step of forming ridges between the grooves, said ridges are constructed of metal and a dielectric surface layer is formed by anodizing the metal to a depth equal to the layer thickness covering the ridges.

15. The method according to claim 3, and further including the step of forming ridges between the grooves, said ridges are constructed of metal and a dielectric surface layer is formed by anodizing the metal to a depth equal to the layer thickness covering the ridges.

16. The method according to claim 4, and further including the step of forming ridges between the grooves, said ridges are constructed of metal and a dielectric surface layer is formed by anodizing the metal to a depth equal to the layer thickness covering the ridges.

17. The method according to claim 5, and further including the step of forming ridges between the grooves, said ridges are constructed of metal and a dielectric surface layer is formed by anodizing the metal to a depth equal to the layer thickness covering the ridges.

18. The method according to claim 8, and further including the step of forming ridges between the grooves, said ridges are constructed of metal and a dielectric surface layer is formed by anodizing the metal to a depth equal to the layer thickness covering the ridges.

19. The method according to claim 7, and further including the step of forming ridges between the grooves, said ridges are constructed of metal and a dielectric surface layer is formed by anodizing the metal to a depth equal to the layer thickness covering the ridges.

20. The method according to claim 8, and further including the step of forming ridges between the grooves, said ridges are constructed of metal and a dielectric surface layer is formed by anodizing the metal to a depth equal to the layer thickness covering the ridges.

21. The method according to claim 9, and further including the step of forming ridges between the grooves, said ridges are constructed of metal and a dielectric surface layer is formed by anodizing the metal to a depth equal to the layer thickness covering the ridges.

22. The method according to claim 10, and further including the step of forming ridges between the grooves, said ridges are constructed of metal and a dielectric surface layer is formed by anodizing the metal to a depth equal to the layer thickness covering the ridges.

* * * * *